United States Patent [19]

Schonstedt et al.

[11] Patent Number: 4,839,623

[45] Date of Patent: Jun. 13, 1989

[54] MAGNETIC CORE BLANKS OF MAGNETICALLY PERMEABLE SHEET MATERIAL

[75] Inventors: Erick O. Schonstedt, Reston; Mohammed M. Hamzezadeh, Fairfax, both of Va.

[73] Assignee: Schonstedt Instrument Company, Reston, Va.

[21] Appl. No.: 153,458

[22] Filed: Feb. 8, 1988

Related U.S. Application Data

[62] Division of Ser. No. 936,629, Dec. 1, 1986.

[51] Int. Cl.[4] ..... H01F 27/24

[52] U.S. Cl. ..... 336/213; 324/260; 336/233; 428/542.8

[58] Field of Search ..... 336/213, 233, 234, 221; 29/418, 557, 558, 6.1, 6.2; 428/542.8; 338/206; 242/7.11; 324/260

[56] References Cited

U.S. PATENT DOCUMENTS

| | | | |
|---|---|---|---|
| 1,128,659 | 2/1915 | Clark | 29/6.2 X |
| 1,370,362 | 3/1921 | Redding | 29/6.1 |
| 1,396,871 | 11/1921 | Napel | 338/206 |
| 2,114,592 | 4/1938 | Cross | 29/6.1 |
| 2,981,885 | 4/1961 | Schonstedt | 336/213 X |
| 3,165,810 | 1/1965 | Aglen | 29/6.2 |
| 3,793,692 | 2/1974 | Tate et al. | 29/6.1 X |

*Primary Examiner*—Thomas J. Kozma

*Attorney, Agent, or Firm*—Shapiro and Shapiro

[57] ABSTRACT

Magnetic cores are manufactured from blanks of magnetically permeable sheet material that have core preforms including strip elements that are partially separated from adjacent portions of the blank. Stabilizer strip elements are provided at opposite sides of the preform and are partially separated from adjacent portions of the blank. A tube is attached to one end of the blank and a weight to an opposite end of the blank. After removal of portions of the blank adjacent to the strip elements, the strip elements are wound upon the tube while tension is applied to the strip elements by virtue of the weight. After the winding, the strip elements of the core preform define a core configuration, and the remainder of the blank is removed.

6 Claims, 1 Drawing Sheet

MAGNETIC CORE BLANKS OF MAGNETICALLY PERMEABLE SHEET MATERIAL

This application is a divisional of U.S. Ser. No. 936,629, now U.S. Pat. No. 4,747,207, filed Dec. 1, 1986.

BACKGROUND OF THE INVENTION

This invention relates to magnetic cores, and more particularly to magnetic core blanks and methods of making magnetic cores from the blanks.

Co-pending Application Ser. No. 891,995, now U.S. Pat. No. 4,803,773, filed Aug. 1, 1986, and assigned to the same assignee as the present invention, discloses improved magnetic cores and core preforms and improved methods of making magnetic cores, preferably utilizing magnetically permeable strip material that is wrapped about a non-magnetic tube forming a core support. In accordance with the invention disclosed in the copending application, incorporated herein by reference, magnetic cores composed of sets of helical convolutions have characteristics similar to those of interwoven strip type cores, while avoiding the high degree of skill required for the manufacture of interwoven cores.

Although the magnetic cores, preforms, and manufacturing methods disclosed in the co-pending application are quite simple, the manufacture of commercial cores in quantity, particularly cores that are very small, requires manufacturing processes that are more easily, reliably, and economically implemented. To attain this goal, the present invention provides novel methods of manufacturing magnetic cores and novel blanks for the manufacture of magnetic cores.

BRIEF DESCRIPTION OF THE INVENTION

In one of its border aspects, a method of making a magnetic core in accordance with the invention comprises the steps of forming from magnetically permeable sheet material a blank having a magnetic core preform portion including strip elements of said material that are partially separated from adjacent portions of the blank, attaching one end of the blank to an elongated support such as a non-magnetic tube, attaching a weight to an opposite end of the blank, winding the preform portion and other, stabilizing portions of the blank upon the support, while applying tension to the wound portions of the blank by virtue of the weight, until the preform portion and stabilizing portions are wrapped about the support, and maintaining the wound configuration of the preform portion of the blank while removing the remainder of the blank therefrom.

In one of its broader aspects, a blank for the manufacture of magnetic cores in accordance with the invention comprises a sheet of magnetically permeable material having a magnetic core preform including strip elements that are partially separated from adjacent portions of the sheet at opposite sides of the preform.

DETAILED DESCRIPTION OF THE INVENTION

Figure 1:
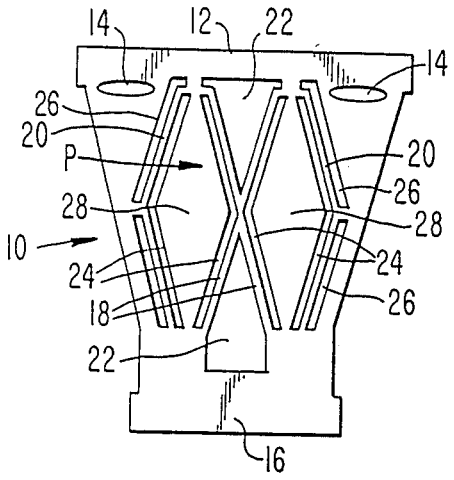
FIG. 1 is a plan view of a magnetic core blank in accordance with the invention.

As shown in FIG. 1, a blank 10 is formed of magnetically permeable sheet material, such as a $\frac{3}{4}$ mil to $\frac{1}{2}$ mil Permalloy sheet. In the form shown, the blank has a somewhat trapezoidal shape, and a series of such blanks, with successive blanks being inverted from the orientation of FIG. 1, may be formed on a long strip of magnetically permeable sheet material. At one end 12 the blank has a pair of spaced holes 14 that are preferably elliptical so as to be elongated along the length of the end 12. The opposite end 16 of the blank is configured for attachment to a weight, as will be described later. Extending between ends 12 and 16 are a magnetic core preform P formed of strip elements 18 and, at opposite sides of the preform, stabilizer strip elements 20. The strip elements are partially separated from adjacent portions of the blank. In the form shown, this is accomplished by providing openings 22, 24, and 26 in the blank. Openings 24 and 26 are strip-shaped and extend longitudinally along strip elements 18 or 20 as shown.

In the preferred form of the invention illustrated, the strip elements 18 of the magnetic core preform P define an X-configuration, although as set forth in the co-pending application other preform configurations are clearly possible. The strip elements 20 define with the strip elements 18 a pair of diamond configurations, the shape of which is apparent from the solid portions 28 of the blank. The solid portions 28, being diamond-shaped, have areas that are substantially greater than the areas of the adjoining strip elements 18 or 20, as shown.

Figure 2:
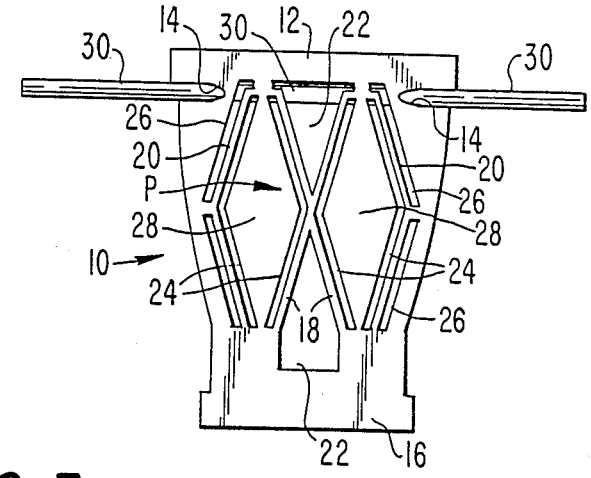
FIG. 2 is a similar view showing the blank attached to a tube.

In the manufacture of a magnetic core in accordance with the invention, a tube 30 of non-magnetic material such as aluminum, or another elongated support, is threaded tightly through the holes 14 as shown in FIG. 2. The holes are precisely positioned on the blank so as to establish a perpendicular relationship between the length of the tube and the length of the X-configuration preform P as shown in FIG. 2.

Figure 3:
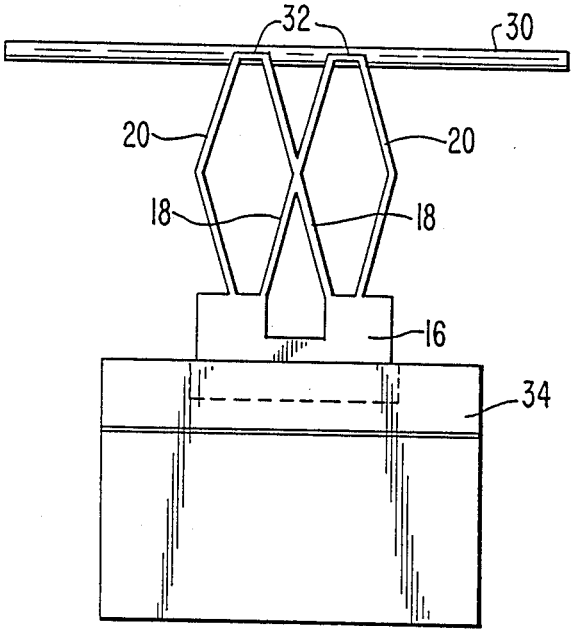
FIG. 3 is an elevation view showing commencement of a core winding operation after removal of non-essential portions of the blank.

The two cross-over sections 32 of the blank that extend between the strip elements 18 and the strip elements 20 at the end 12 of the blank are affixed to the tube 30, as shown in FIG. 3, by welding, for example, and the portions of the blank except for the strip elements and the end 16 are then removed by cutting the blank. A small weight 34 is attached to end 16 of the blank, as by adhesive, for example. Then the strip elements 18 and 20 are wound about the tube 30 by turning the tube about its longitudinal axis, with the weight 34 suspended from the strip elements as shown in FIG. 3, so that constant tension is applied to the strip elements during the winding operation. Strip elements 20 serve as stabilizers for strip elements 18, so that a precise X-configuration of elements 18 is maintained throughout the winding operation.

Figure 4:
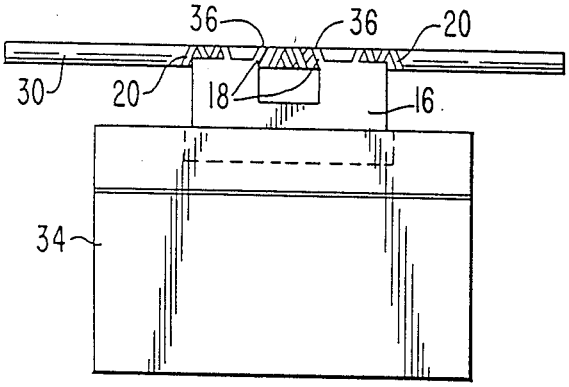
FIG. 4 is a similar view after completion of the winding operation.
Figure 5:
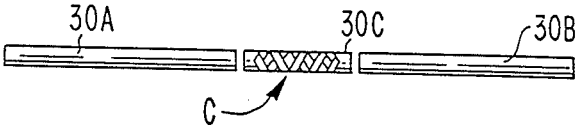
FIG. 5 is a plan view showing a finished magnetic core and portions of the tube that have been removed.

When the winding operation is complete, as shown in FIG. 4, portions 36 of the strip elements 18 at the extremities thereof adjacent to the end 16 of the blank are affixed to underlying portions of the strip elements 18, preferably by welding. All of the blank material except for the wound strip elements 18 is then removed by cutting. The tube 30 is cut to a final length, as shown in FIG. 5, and tube portions 30A and 30B are removed.

This provides a wound core C on a portion 30C of the tube 30.

The invention has been used to form magnetic cores 0.125 inch long, on tubes 0.200 inch long and 0.030 inch diameter, from magnesium oxide coated 4-79 Permalloy, with the pattern of openings in the blank being produced by a photo-etching process. As described in the aforesaid co-pending application, the cores produced in accordance with the invention comprise superposed layers of magnetically permeable material, one of the layers being constituted by a first set of helical convolutions with a helix angle in one direction followed longitudinally by a second set of helical convolutions with a helix angle in the opposite direction, and another of the layers being constituted by a third set of helical convolutions superposed upon the first set but with a helix angle in the opposite direction and a fourth set of helical convolutions superposed upon the second set but with a helix angle in said one direction. By virtue of the invention, small (and other) magnetic cores having characteristics similar to those of interwoven strip type cores, for example, are produced easily, reliably, and economically, while avoiding the high degree of skill required for the manufacture of comparable more conventional cores.

While a preferred embodiment of the invention has been shown and described, it will be apparent to those skilled in the art that changes can be made in the embodiment without departing from the principles and spirit of the invention, the scope of which is defined in the appended claims.

The invention claimed is:

1. A blank for the manufacture of a magnetic core, comprising a sheet of magnetically permeable material having a magnetic core preform including strip elements that define an X-configuration and stabilizer strip elements at opposite sides of the X-configuration, respectively, and defining therewith two diamond configurations, said strip elements being partially separated from said blank by strip-shaped openings extending longitudinally along respective strip elements at opposite sides thereof, said diamond configurations including portions of said sheet adjoining said X-configuration at opposite sides thereof and having areas that are substantially greater than the areas of said strip elements at either side of said diamond configurations.

2. A blank in accordance with claim 1, wherein said blank has a pair of holes spaced along one end of the blank.

3. A blank in accordance with claim 2, wherein each of said holes is elongated in a direction along said one end of the blank.

4. A blank in accordance with claim 2, wherein an opposite end of the blank has an area adapted to be attached to a weight.

5. A blank for the manufacture of a magnetic core, comprising a sheet of magnetically permeable material having a magnetic core preform including strip elements that define an X-configuration and stabilizer strip elements that define with the strip elements of the X-configuration two diamond configurations, said diamond configurations including portions of said sheet adjoining said X-configuration at opposite sides thereof, said strip elements being partially separated from adjoining portions of the blank by openings formed by the removal of material from said sheet.

6. A blank in accordance with claim 5, wherein said magnetically permeable material is Permalloy and said sheet has a thickness that is a fraction of a mil.

* * * * *